US009016219B2

(12) United States Patent
Tseng

(10) Patent No.: US 9,016,219 B2
(45) Date of Patent: Apr. 28, 2015

(54) TENSION RELEASE DEVICE FOR COMPENSATING MECHANICAL ERROR OF A TENSION DEVICE FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 44 days.

(21) Appl. No.: 14/027,547

(22) Filed: Sep. 16, 2013

(65) Prior Publication Data

US 2015/0075414 A1 Mar. 19, 2015

(51) Int. Cl.
*D05B 47/00* (2006.01)

(52) U.S. Cl.
CPC ..... *D05B 47/00* (2013.01)

(58) Field of Classification Search
CPC ..... D05B 47/00
USPC ..... 112/254, 238, 255, 242, 243, 272, 273, 112/302, 233; 242/150 R, 419.4, 419.5, 242/147 R
See application file for complete search history.

(56) References Cited

U.S. PATENT DOCUMENTS

| | | | | |
|---|---|---|---|---|
| 1,182,273 | A * | 5/1916 | Hohmann | 112/254 |
| 2,050,790 | A * | 8/1936 | Goodman | 112/254 |
| 3,150,846 | A * | 9/1964 | Laidig | 242/150 R |
| 3,366,083 | A * | 1/1968 | Ketterer et al. | 112/254 |
| 3,721,205 | A * | 3/1973 | Ono et al. | 112/254 |
| 4,803,936 | A * | 2/1989 | Mikuni et al. | 112/254 |
| 8,096,250 | B2 * | 1/2012 | Takeshita | 112/254 |

* cited by examiner

*Primary Examiner* — Tejash Patel
(74) *Attorney, Agent, or Firm* — Patent Office of Bang Shia

(57) ABSTRACT

A tension release device for compensating mechanical error of a tension device for a sewing machine includes a rotary arm, a tension release shaft, a guiding member, an actuating member, and a micro-adjustment member, the rotary arm is located at one end of the tension release shaft which is inserted through the base, the tension release shaft is coupled to the guiding member, the guiding member is provided with an arc-shaped guiding flange which includes a first end and a second end higher than the first end. On the actuating member is provided a push portion which protrudes toward and is pushed by the guiding flange of the guiding member, a micro-adjustment hole is formed at one end of the actuating member or at the one end of the control shaft, and the micro-adjustment member is screwed in the micro-adjustment hole and extends toward the tension release shaft.

10 Claims, 7 Drawing Sheets

TENSION RELEASE DEVICE FOR COMPENSATING MECHANICAL ERROR OF A TENSION DEVICE FOR A SEWING MACHINE

BACKGROUND OF THE INVENTION

1. Field of the Invention

The present invention relates to a tension release device, and more particularly to a tension release device for compensating mechanical error of a tension device for a sewing machine.

2. Description of the Prior Art

For the technology on the tension device used on a sewing machine to control the tension of the sewing thread and the tension release device for controlling the tension device, the applicant of this applicant has applied for a patent called "a control device used on a sewing machine capable of coaxially releasing the tension device and the pressure of the presser" and successfully got it approved. The characteristic of the applicant's prior patent is that a control handle for controlling lifting and lowering of the presser also controls a linkage of the tension device, so as to simultaneously control the lifting and lowering of the presser, as well as the tension of the thread. The linkage includes a swaying member to the tension device and sways in a two-dimensional fashion to push the top of the tension device, therefore, the accuracy of the motion of the linkage is limited. In addition, accumulation or abrasion caused error will occur after a certain time of period of use or after the tension device and the linkage are assembled together, and cannot be adjusted.

The present invention has arisen to mitigate and/or obviate the afore-described disadvantages.

SUMMARY OF THE INVENTION

The primary objective of the present invention is to provide a tension release device capable of compensating mechanical error of a tension device for a sewing machine.

To achieve the above objective, a tension release device for compensating mechanical error of a tension device for a sewing machine is provided by the present invention. On a top of a base of the sewing machine is provided at least one said thread tension device, and each said at least one thread tension device for controlling tension of sewing thread is provided with an upright control wheel sleeved on a control shaft which is pivoted to a shaft holder on the base. The tension release device is pressed against one end of the control shaft, at one side of the base is slidably provided a presser rod driven by a actuating device, and at one end of the presser rod is fixed a presser. The tension release device is characterized in that:

the tension release device includes a rotary arm, a tension release shaft, a guiding member, an actuating member, and a micro-adjustment member, the rotary arm is located at one end of the tension release shaft which is inserted through the base, the tension release shaft is coupled to the guiding member and serves as a rotation center of the guiding member, the guiding member is provided at a side thereof facing the actuating member with an arc-shaped guiding flange which includes a first end and a second end higher than the first end;

on the actuating member is provided a push portion which protrudes toward and is pushed by the guiding flange of the guiding member, a micro-adjustment hole is formed at one end of the actuating member or at the one end of the control shaft, and the micro-adjustment member is screwed in the micro-adjustment hole and extends toward the tension release shaft.

DETAILED DESCRIPTION OF THE PREFERRED EMBODIMENTS

Figure 1:
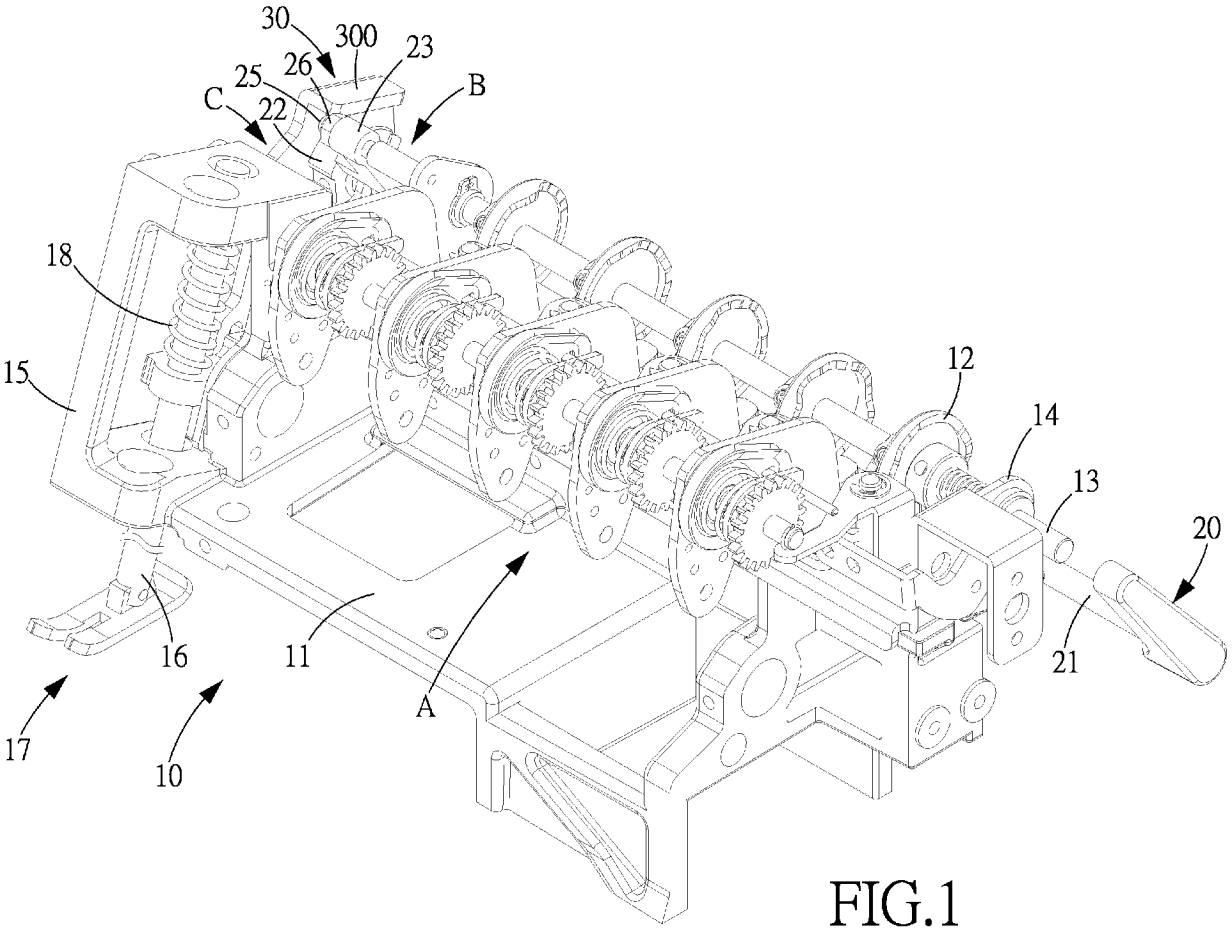
FIG. 1 is a perspective view showing that a tension release device for compensating mechanical error of a tension device for a sewing machine in accordance with the present invention is mounted on a base of the sewing machine.

The present invention will be clearer from the following description when viewed together with the accompanying drawings, which show, for purpose of illustrations only, the preferred embodiment in accordance with the present invention.

Referring to FIGS. 1-7, on the top of a base 11 of a sewing machine 10 of the present invention is provided at least one thread tension device A, and each thread tension device A is provided with an upright control wheel 12 in the form of a cam structure to make the tension device A control the tension of thread. All the control wheels 12 are coaxially inserted on a control shaft 13 which is pivoted to a shaft holder 14 on the base 11. A tension release device B for controlling the tension device A to or not to release the tension of the thread is pressed against one end of the control shaft 13. At one side of the base 11 is provided a presser rod holder 15 for holding a presser rod 16, and to the end of the presser rod 16 is coupled a presser 17. On the presser rod 16 is sleeved a spring 18 for exerting a prestress pushing the presser rod 16 and the presser 17 downward. The presser rod 16 is driven by a actuating device C, and the actuating device C is driven by the tension release device B to lift or lower the presser 17. On the base 11 is further provided a mounting frame 19 for holding the tension release device B and the actuating device C.

The present invention is characterized in that the tension release device B is easy to operate, the control shaft 13 can be assuredly pushed to move by the components which move along the axial direction of the control shaft 13, and on the control shaft 13 is provided a micro-adjustment structure which is located at a position where the tension release device B pushes against the tension device A to eliminate mechanical error between the tension release device B and the tension device A. furthermore, the cooperation of the tension release device B and the actuating device C improves the accuracy of the movement and adjustment of the presser 17.

Figure 2:
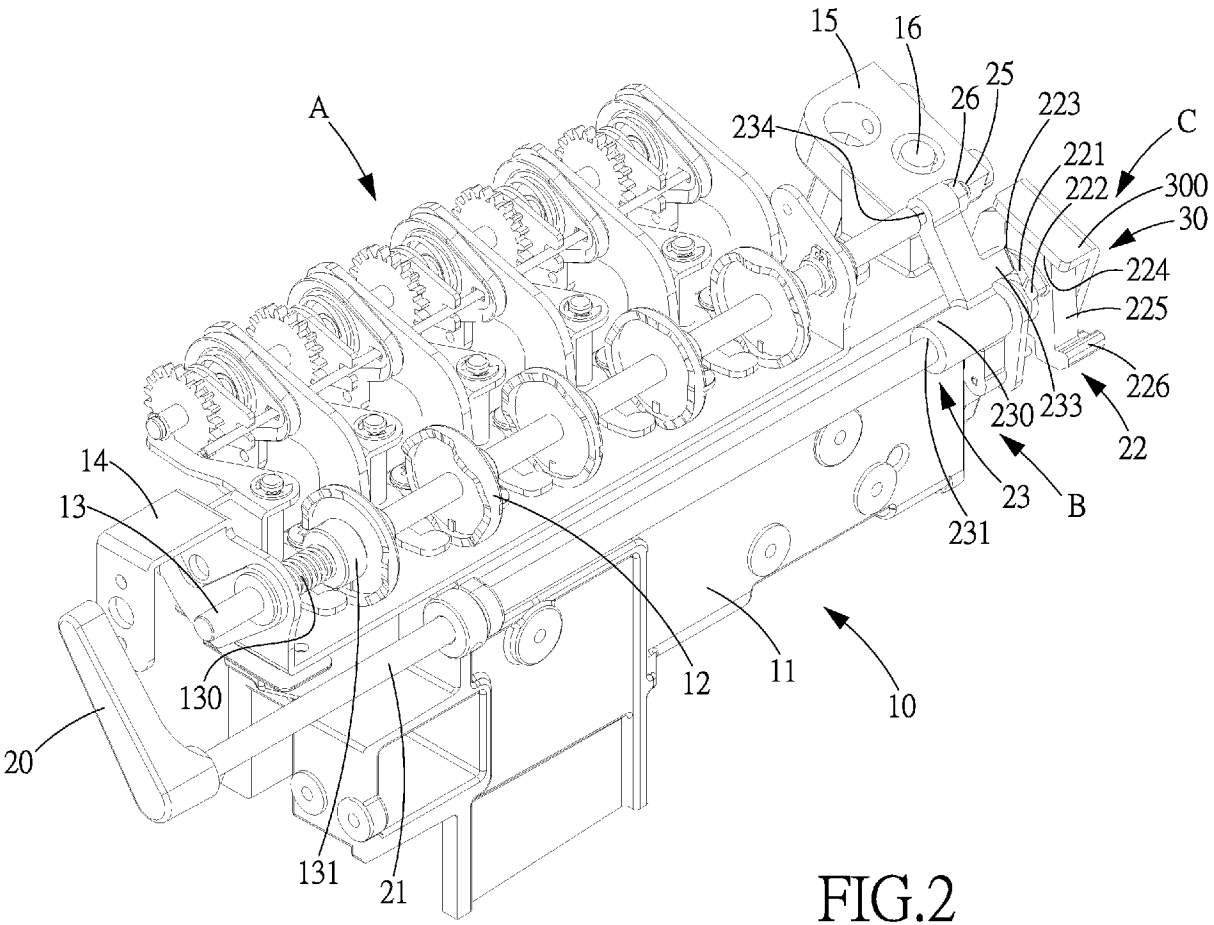
FIG. 2 is a rear view of FIG. 1.
Figure 3:
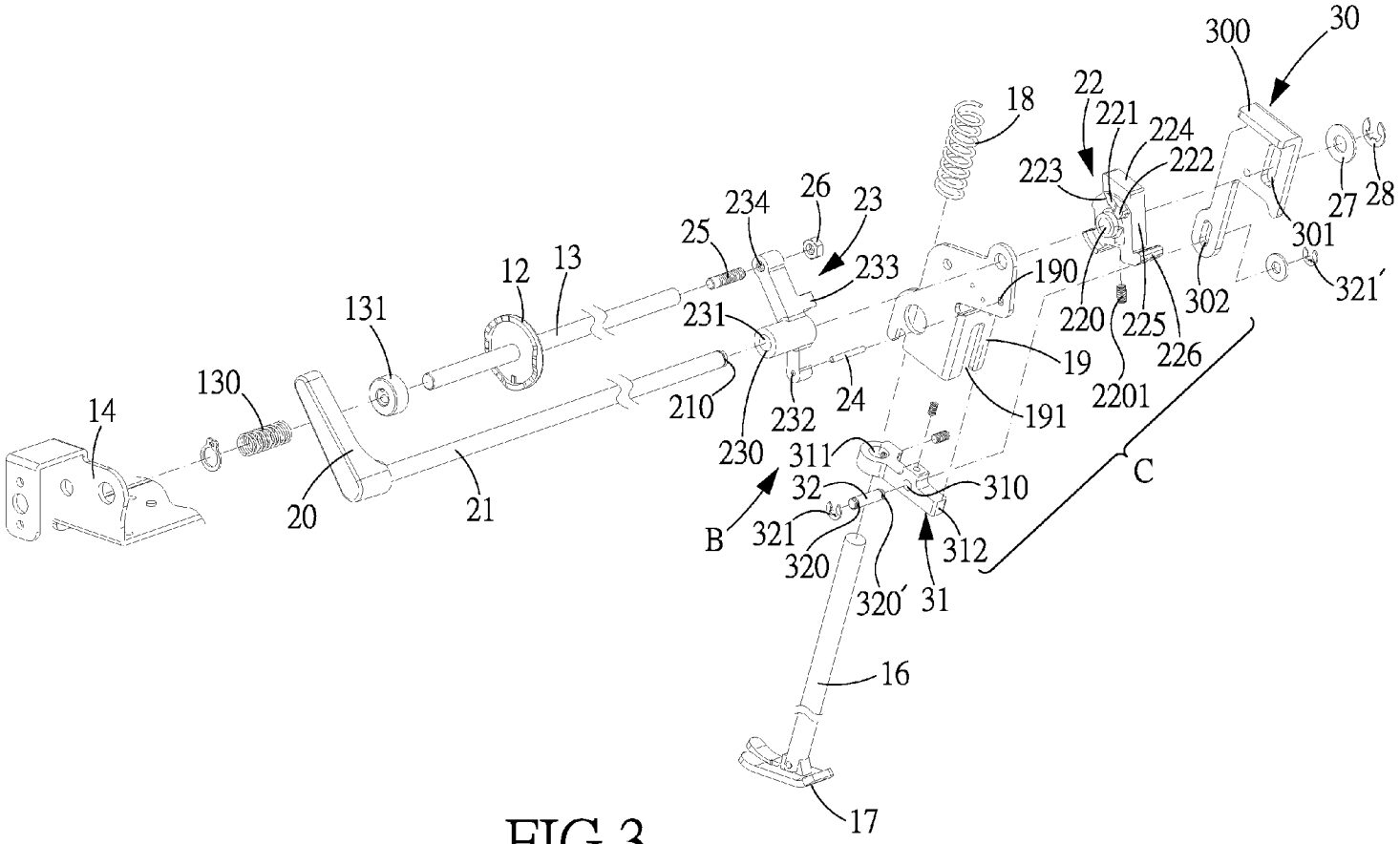
FIG. 3 is an exploded view of the tension release device and the actuating device in accordance with the present invention.

The tension release device B includes a rotary arm 20, a tension release shaft 21, a guiding member 22, an actuating member 23, a pin 24, a micro-adjustment member 25 and a locking member 26. The rotary arm 20 has one end extending out of the sewing machine 10 for the user to operate. As shown in FIGS. 1-3, the rotation center of the rotary arm 20 is located at one end of the tension release shaft 21 which is inserted through the shaft holder 14, the mounting frame 19, the guiding member 22 and the actuating member 23. The guiding member 22 is a disc-shaped structure which is provided at the rotation center thereof with an inserting hole 220, and the tension release shaft 21 is inserted in the inserting hole 220 and fixed therein by a bolt 2201 screwing across the inserting hole 220. The guiding member 22 is provided at a side thereof facing the actuating member 23 with an arc-shaped guiding flange 221 surrounding the inserting hole 220. The guiding flange 221 includes a first end 222, and a second end 223 higher than the first end 222, and the guiding flange 221 takes the form of an inclined flange connected between the first end 222 and the second end 223. At an outer periphery of the guiding member 22 are provided a first edge 224 and a second edge 225 which is located closer to the center of the inserting hole 220 than the first edge 224, namely, the second edge 225 has a height with respect to the rotation center of the guiding member 22 lower than the height of the first edge 224 with respect to the rotation center of the guiding member 22, so as to control the height of the presser 17. The guiding member 22 is further provided at the outer periphery thereof with a restricting portion 226 which has a width greater than the thickness of the guiding member 22. In the embodiment as shown in FIG. 3, the restricting portion 226 protrudes from one end of the second edge 225 and serves to engage with relative components of the base 11, so as to limit the travel length (namely, rotation angle) of the guiding member 22.

The actuating member 23 is provided at the center thereof with a hollow tubular pivot portion 230 which is formed with a pivot hole 231 for insertion of the tension release shaft 21, so that the actuating member 23 is slidably sleeved on the tension release shaft 21. At one end of the actuating member 23 is formed a pin hole 232 which is in parallel to the pivot hole 231 and provided for insertion of the pin 24, and the pin 24 is inserted through the pivot hole 231 and a pivot aperture 190 formed in the mounting frame 19, so that the actuating member 23 is assured to move along the tension release shaft 21 without rotation. Adjacent the pivot portion 230 is formed a push portion 233 which is square in cross section and protrudes toward and is pushed and driven by the guiding flange 221 of the guiding member 22. At another end of the actuating member 23 extending toward the tension release shaft 21 is formed a threaded micro-adjustment hole 234. The micro-adjustment member 25 is a bolt screwed in the micro-adjustment hole 234 and extends toward the tension release shaft 21. The micro-adjustment member 25 is locked on the actuating member 23 by the locking member 26. The locking member 26 should be loosened before adjustment of the micro-adjustment member 25 and then tightened again after adjustment.

The actuating device C includes a actuating arm 30, a connecting block 31 for connecting the actuating arm 30 and the presser rod 16, and a rod 32 for connecting the actuating arm 30 and the connecting block 31. The actuating arm 30 is formed by folding a sheet material into a desired shape. At the top of the actuating arm 30 is formed an L-shaped abutting portion 300 extending toward the guiding member 22. A first slot 301 is formed in the actuating arm 30 and extends along the axial direction of the presser rod 16, and at the end of the actuating arm 30 extending toward the connecting block 31 is formed a second slot 302 for insertion of the rod 32 which is used to connect the actuating arm 30 to the connecting block 31.

Another end of the tension release shaft 21 is inserted through the guiding member 22 and the first slot 301 and formed with an annular engaging groove 210, and then a washer 27 and a C or E-shaped ring 28 are engaged in the annular engaging groove 210 to couple the actuating arm 30 to the tension release shaft 21, and the actuating arm 30 is movable along the tension release shaft 21 and the first slot 301.

The connecting block 31 is an elongated structure and formed at the center thereof with a rod hole 310. The rod 32 is inserted through the second slot 302 and the rod hole 310 in such a manner that both ends of the rod 32 extend out of the second slot 302 and the rod hole 310 and are formed with an annular groove 320, 320' for engaging with a C or E-shaped ring 321, 321', so as to fix the rod 32 to the connecting block 31. The connecting block 31 is formed at one end thereof with a presser rod hole 311, and the presser rod 16 is inserted through the presser rod hole 311 and fixed there by a bolt in such a manner that the spring 18 is disposed between the presser rod holder 15 and the connecting block 31 to exert a downward force on the presser rod 16, the connecting block 31 and the actuating arm 30, enabling the abutting portion 300 of the actuating arm 30 to be assuredly pressed against the first or second edge 224, 225 of the guiding member 22. At another end of the connecting block 31 is formed with a guiding portion 312 which is to be slidably received in a reversed U-shaped guiding slot 191 formed in the mounting frame 19, thereby ensuring accurate and smooth movement of the connecting block 31 and the presser rod 16.

On the control shaft 13 is sleeved a prestress member 130 in the form of a spring which is disposed between the shaft holder 14 and a washer 131 of an adjacent control wheel 12, and the washer 131 is screwed on the control shaft 13, so as to exert a prestress on the tension release shaft 21 for pushing it toward the actuating member 23 and the micro-adjustment member 25, ensuring that the control shaft 13 is pushed against the end of the micro-adjustment member 25.

Figure 4:
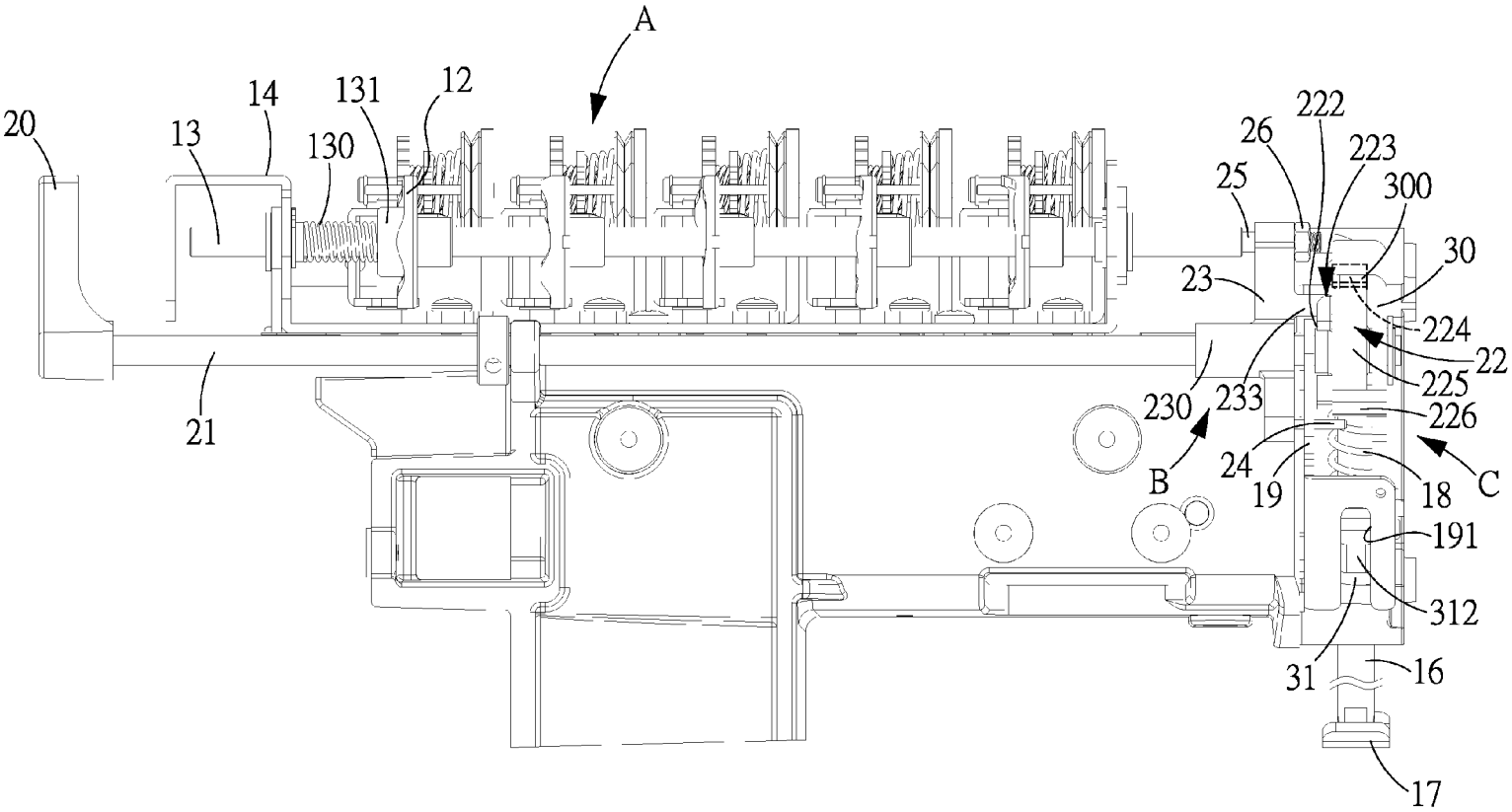
FIG. 4 is an operational view of the present invention showing that the tension device is in a tension released position, and the presser is lifted by the actuating device.

Referring to FIGS. 2 and 4, in the initial stage, the rotary arm 20 is positioned at a relatively high elevation angle, the first end 222 of the guiding flange 221 of the guiding member 22 is aligned to the push portion 233 of the actuating member 23. The actuating member 23 is in a backward position, the control shaft 13 is pushed by the prestress member 130, the micro-adjustment member 25 pushes the control shaft 13, bringing the control wheels 12 into a tension released position with respect to the tension device A. The first edge 224 of the guiding member 22 is pushed against the abutting portion 300 of the actuating arm 30 to make the actuating arm 30 and the connecting block 31 keep the presser rod 16 and the presser 17 at their high positions, and the restricting portion 226 is pressed downward against the lateral edge of the actuating arm 30, forming the start point of the travel (rotation) of the guiding member 22.

Figure 5:
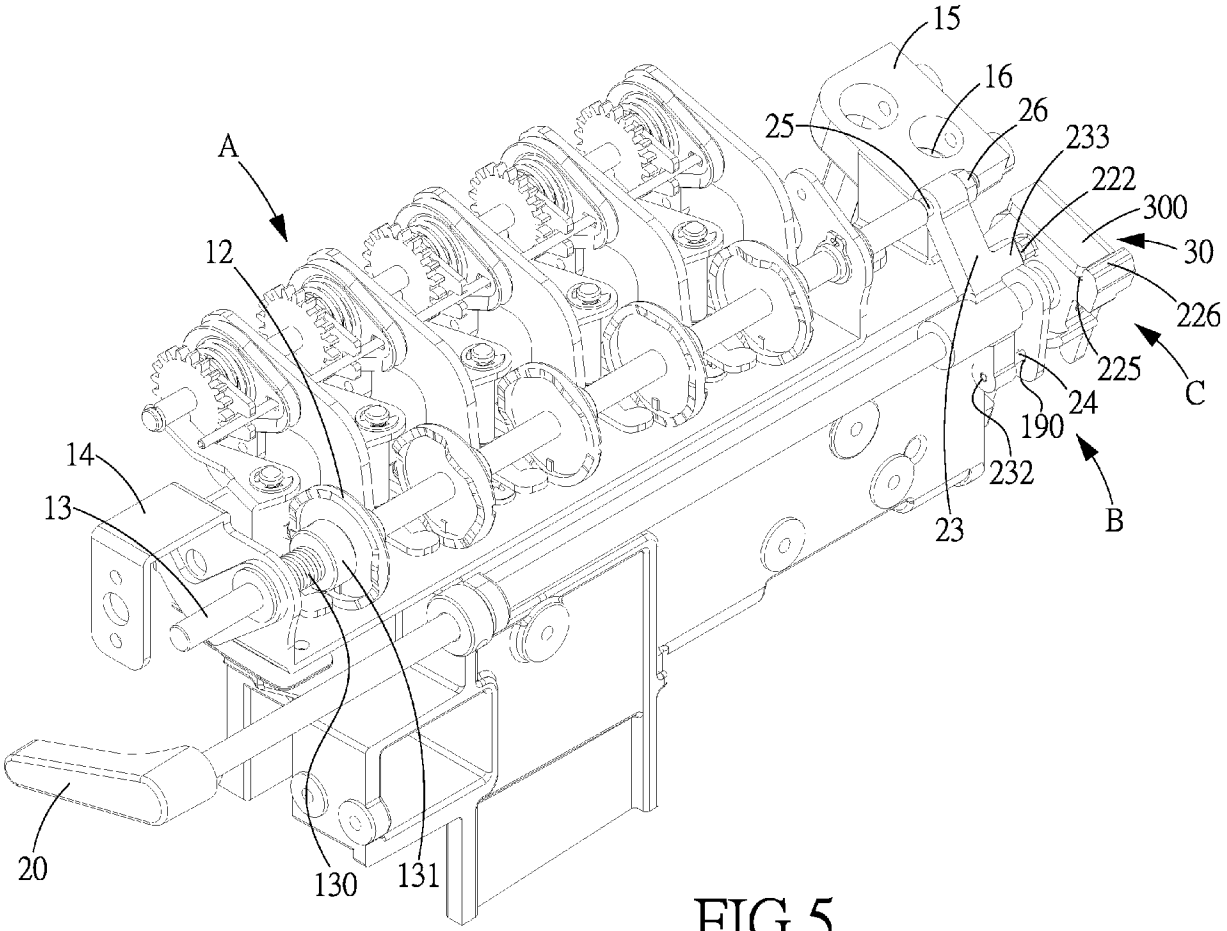
FIG. 5 is an operational view of the present invention showing that the tension release device is pulled to the tension released position.
Figure 6:
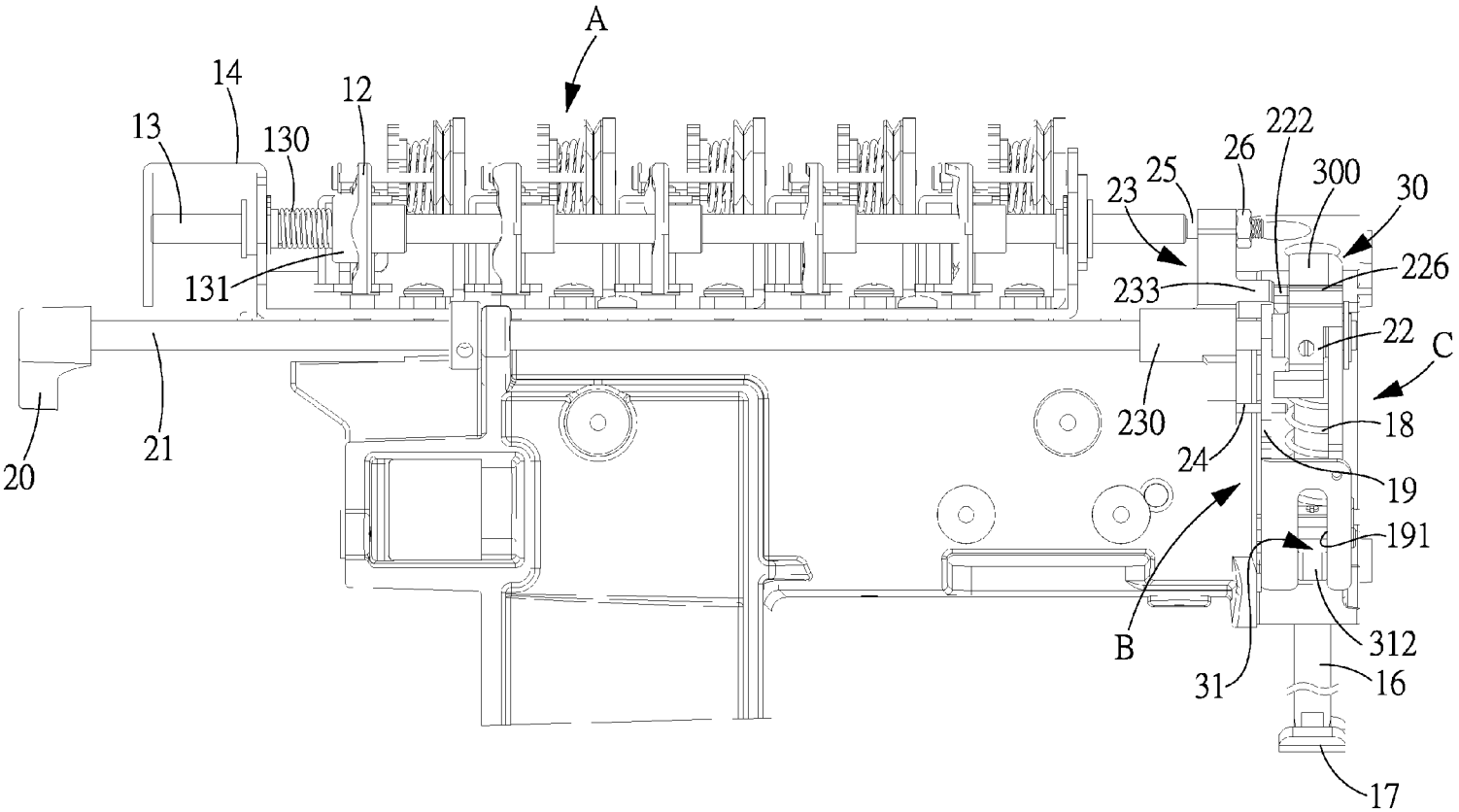
FIG. 6 is an operational view of the present invention showing that the tension device is not in a tension released position, and the presser is lowered by the actuating device.

When the rotary arm 20 is pressed down to a relatively low elevation angle, as shown in FIGS. 5 and 6, the guiding member 22 will rotate along with the tension release shaft 21 to make the guiding flange 221 move from the first end 222 to the second end 223, where the guiding flange 221 is aligned to the push portion 233 of the actuating member 23. At this moment, the micro-adjustment member 25 on the actuating member 23 starts to push against the control shaft 13 to make the control wheel 12 on the control shaft 13 exert a prestress on the prestress member 130, so that the control wheel 12 is in a tensioned position with respect to the tension device A, where the second edge 225 of the guiding member 22 pushes against the abutting portion 300 of the actuating arm 30, to make the actuating arm 30 and the connecting block 31 move the presser rod 16 and the presser 17 toward their low positions, so that sewing operation can be carried out. The restricting portion 226 is abutted against the abutting portion 300 of the actuating arm 30, forming the end point of the travel (rotation) of the guiding member 22.

When an error occurs in the positions of the start and end points of the travel, where the tension device A and the tension release device B exert or release a tension force, the accuracy of the tension release action performed by the tension release device B can be adjusted by rotating the micro-adjustment member 25 on the actuating member 23 to adjust the length of the micro-adjustment member 25 extending in the axial direction of the control shaft 13.

Figure 7:
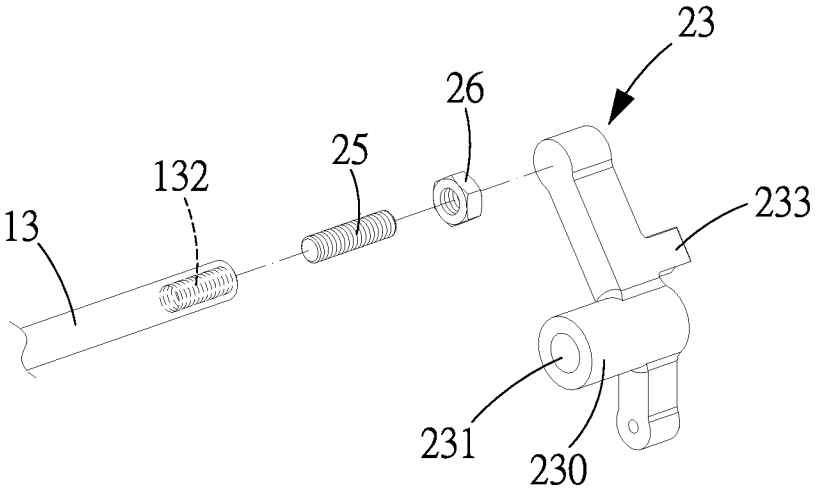
FIG. 7 is an exploded view of a part of the tension released device in accordance with another embodiment of the present invention.

Referring then to FIG. 7, the micro-adjustment member 25 can also be disposed at the end of the control shaft 13 in such a manner that the end of the control shaft 13 is formed with a threaded micro-adjustment hole 132, the micro-adjustment member 25 is screwed in the micro-adjustment hole 132, then the locking member 26 is screwed on the micro-adjustment member 25 and tightened against the end of the control shaft 13, and the end of the micro-adjustment member 25 extends out of the micro-adjustment hole 132 to push against the actuating member 23.

While we have shown and described various embodiments in accordance with the present invention, it is clear to those skilled in the art that further embodiments may be made without departing from the scope of the present invention.

What is claimed is:

1. A tension release device for compensating mechanical error of a tension device for a sewing machine, on a top of a base of the sewing machine being provided at least one said thread tension device, and each said at least one thread tension device for controlling tension of sewing thread being provided with an upright control wheel sleeved on a control shaft which is pivoted to a shaft holder on the base, the tension release device being pressed against one end of the control shaft, at one side of the base being slidably provided a presser rod driven by a actuating device, at one end of the presser rod being fixed a presser, the tension release device being characterized in that:

the tension release device includes a rotary arm, a tension release shaft, a guiding member, an actuating member, and a micro-adjustment member, the rotary arm is located at one end of the tension release shaft which is inserted through the base, the tension release shaft is coupled to the guiding member and serves as a rotation center of the guiding member, the guiding member is provided at a side thereof facing the actuating member with an arc-shaped guiding flange which includes a first end and a second end higher than the first end;

on the actuating member is provided a push portion which is pushed against the guiding flange of the guiding member, a micro-adjustment hole is formed at one end of the actuating member or at the one end of the control shaft, and the micro-adjustment member is screwed in the micro-adjustment hole and extends toward another end of the actuating member or the control shaft.

2. The tension release device for compensating mechanical error of the tension device for the sewing machine as claimed in claim 1, wherein the guiding member is provided with an inserting hole, and the tension release shaft is inserted in the inserting hole and fixed therein by a bolt, the guiding flange is arc-shaped and surrounds the inserting hole and takes the form of an inclined flange connected between the first and second ends, the actuating member is provided with a hollow tubular pivot portion which is formed with a pivot hole for insertion of the tension release shaft, at one end of the actuating member is formed a pin hole for insertion of a pin, the pin is inserted through the pivot hole and into the mounting frame.

3. The tension release device for compensating mechanical error of the tension device for the sewing machine as claimed in claim 1, wherein the tension release device further includes a locking member to fix the micro-adjustment member.

4. The tension release device for compensating mechanical error of the tension device for the sewing machine as claimed in claim 1, wherein the guiding member are provided at an outer periphery thereof with a first edge and a second edge which is located closer to a center of the inserting hole than the first edge, the actuating device includes a actuating arm, and at a top of the actuating arm is formed an abutting portion extending toward the guiding member.

5. The tension release device for compensating mechanical error of the tension device for the sewing machine as claimed in claim 1, wherein the guiding member is further provided at an outer periphery thereof with a restricting portion which serves to engage with the actuating arm, so as to limit rotation of the guiding member.

6. The tension release device for compensating mechanical error of the tension device for the sewing machine as claimed in claim 1, wherein the guiding member are provided at an outer periphery thereof with a first edge and a second edge which is located closer to a center of the inserting hole than the first edge, the actuating device includes a actuating arm, and at a top of the actuating arm is formed an abutting portion extending toward the guiding member;

the actuating device includes a actuating arm and a connecting block for connecting the actuating arm and the presser rod, a first slot for insertion of the tension release shaft is formed in the actuating arm and extends along an axial direction of the presser rod, the actuating arm has one end coupled to the connecting block, the presser rod is fixed at one end of the connecting block, and a spring is pressed against the connecting block.

7. The tension release device for compensating mechanical error of the tension device for the sewing machine as claimed in claim 6, wherein a second slot for insertion of the rod which is used to connect the actuating arm to the connecting block is formed at the one end of the actuating arm, the connecting block is formed at a center thereof with a rod hole, the rod is inserted through the rod hole in such a manner that both ends of the rod extend out of the rod hole and are engaged with a fastener, the connecting block is formed at the one end thereof with a presser rod hole, and the presser rod is inserted through the presser rod hole and fixed there by a bolt, at another end of the connecting block is formed with a guiding portion which is to be slidably received in a guiding slot formed in the base.

8. The tension release device for compensating mechanical error of the tension device for the sewing machine as claimed in claim 1, wherein a prestress member is sleeved on the control shaft and disposed between the shaft holder and a washer of an adjacent control wheel to exert a prestress on the tension release shaft for pushing the tension release shaft toward the actuating member.

9. The tension release device for compensating mechanical error of the tension device for the sewing machine as claimed in claim 1, wherein the micro-adjustment member is screwed to the one end of the actuating member.

10. The tension release device for compensating mechanical error of the tension device for the sewing machine as claimed in claim 1, wherein the micro-adjustment member is screwed to the one end of the control shaft.

* * * * *